United States Patent [19]

Nitschke

[11] Patent Number: 4,592,611

[45] Date of Patent: Jun. 3, 1986

[54] ELECTRICAL CONNECTOR INTENDED FOR USE IN CONFINED AREAS

[75] Inventor: Reinhard Nitschke, Frankfurt am Main, Fed. Rep. of Germany

[73] Assignee: AMP Incorporated, Harrisburg, Pa.

[21] Appl. No.: 655,121

[22] Filed: Sep. 27, 1984

[51] Int. Cl.[4] ..... H01R 13/62

[52] U.S. Cl. ..... 339/91 R; 339/126 R; 339/126 RS; 339/258 P

[58] Field of Search ..... 339/91 R, 126 R, 126 RS, 339/256 SP, 258 F, 258 S, 276 F, 245, 4, 184 M

[56] References Cited

U.S. PATENT DOCUMENTS

| | | | |
|---|---|---|---|
| 3,215,975 | 11/1965 | Kinkaid | 339/184 M |
| 3,601,746 | 8/1971 | Teagno | 339/4 |
| 3,654,586 | 4/1972 | Winkler | 339/184 M |
| 3,706,066 | 12/1972 | Shroyer | 339/126 R |
| 3,753,212 | 8/1973 | Yamada et al. | 339/91 R |
| 4,030,804 | 6/1977 | Enomoto | 339/258 S |
| 4,458,971 | 7/1984 | D'Urso et al. | 339/258 S |

*Primary Examiner*—Gil Weidenfeld
*Assistant Examiner*—David L. Pirlot
*Attorney, Agent, or Firm*—Frederick W. Raring

[57] ABSTRACT

Electrical connector assembly intended for use in confined spaces comprises first and second housings which, when mated, from an L-shaped structure. The first housing has an integral radially extending collar and latch arms on its external surface by means of which it can be mounted in an opening in a panel. When the second housing is coupled to the first housing, the second housing will extend parallel to the surface of the panel and will not project a substantial distance beyond the surface. Blade type terminals are used in the first housing and terminals having opposed spring arms are used in the second housing. The terminals having spring arms are mated with the blade type terminals by moving the spring arm terminals against and past the side edges of the blade type terminals.

7 Claims, 8 Drawing Figures

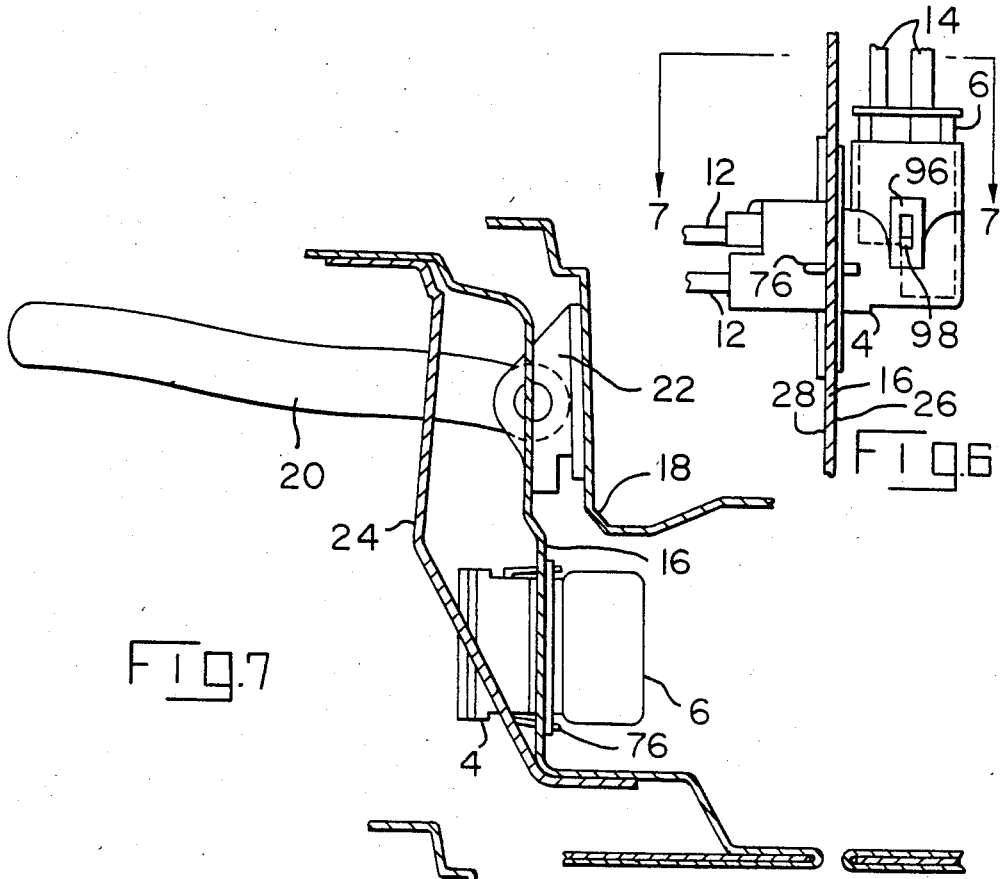
FIG. 6
FIG. 7
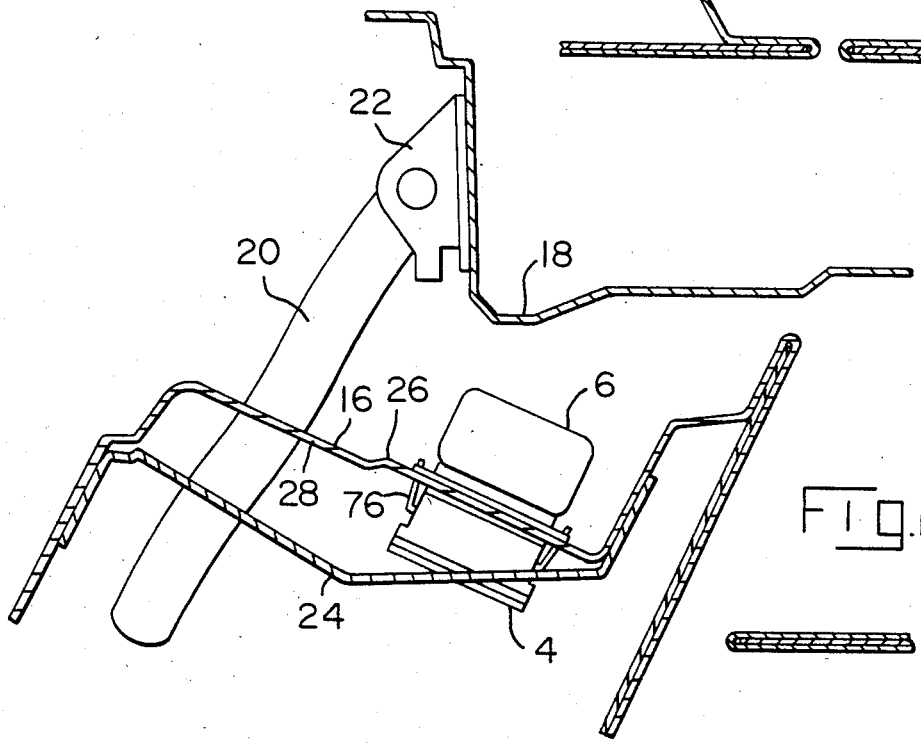
FIG. 8

ELECTRICAL CONNECTOR INTENDED FOR USE IN CONFINED AREAS

FIELD OF THE INVENTION

This invention relates to electrical connectors of the type comprising a plug and a receptacle and particularly, to connectors intended for use in confined spacers such as on a panel of an automobile door which is opposed to and close to a frame panel.

BACKGROUND OF THE INVENTION

It is frequently required that a portion of the harness of a motor vehicle must extend into one or more of the doors of the vehicle to supply power to devices such as lighters, radio speakers and window winders. Most of the commonly available electrical connector assemblies are not suitable for use in automobile doors for the reason that portions of the assembly normally extend for substantial distance beyond the surface in which the connector assembly is mounted and the space between the door panel and the frame panel of an automobile is not sufficient to accommodate the connector. The present invention is directed to the achievement of an electrical connector assembly which is specifically intended for use in confined spaces such as on automobile door panels and which possess advantages which are found in conventional electrical connectors; for example, the invention is directed to the achievement of a connector which is easily serviced and which can be removed from the panel for repair of adjustment. The invention is further directed to the achievement of a connector which uses readily available standard terminals rather than specially designed terminals.

THE INVENTION

The invention comprises a panel mounted electrical connector assembly intended for use in confined spaces and comprising first and second connector housings having first and second terminals therein. Each of the housings has a wire entry face and a mating face, the mating faces being substantially against each other and the contact terminals being engaged with each other when the housings are assembled to each other. Wires extend into the wire entry faces of the housings and are connected to the terminals. The connector assembly is characterized in that its substantially L-shaped, the first housing being one of the arms of the L and the second housing being the other arm. The mating faces of the first and second housings are at the junction of the arms and the wire entry faces of the housings are at the free ends of the arms. The first terminals in the first housing are rectangular blade terminals having side edges which extend to their free ends and having oppositely facing major surfaces between the side edges. The blade terminals are in alignment with each other in spaced-apart parallel planes in a row. The terminals in the second housing comprise receptacle terminals arranged in a row which receive the blade terminals. One of the housings is mountable in an opening in a panel so that the wire entry face of the one housing is on one side of the panel and the mating face is on the other side.

In accordance with further embodiments, the first housing is mountable in an opening in a panel and has mounting means in the form of a collar and latch arms on its external surface. The latch arms extend forwardly towards the mating face and through openings in the collar. The latch arms have shoulders which bear against the opposite surface of the panel from the surface against which the collar bears.

In accordance with further embodiments, each of the second terminals has a contact portion comprising at least one pair of opposed spring arms. The arms have free ends between which the blade of a terminal in the first housing is received when the housings are mated.

In accordance with a further embodiment, the blade terminals and the receptacle terminals in the first and second housings are mounted in two rows with the leading ends of the terminal in one row being located beyond the leading ends of the terminals of the other row. The terminals of the rows are staggered to permit engagement of the terminals of the two housings when the housings are mated.

THE DRAWING FIGURES

FIG. 6 is a semi-diagrammatic side view showing a connector assembly mounted in a panel.

FIG. 7 is a view looking in the direction of the arrows 7—7 of FIG. 6, this view showing generally other details of the door and frame structure of a motor vehicle when the door is closed.

FIG. 8 is a view similar to FIG. 7 showing the positions of the parts when the door is opened.

THE DISCLOSED EMBODIMENT

Figure 1:
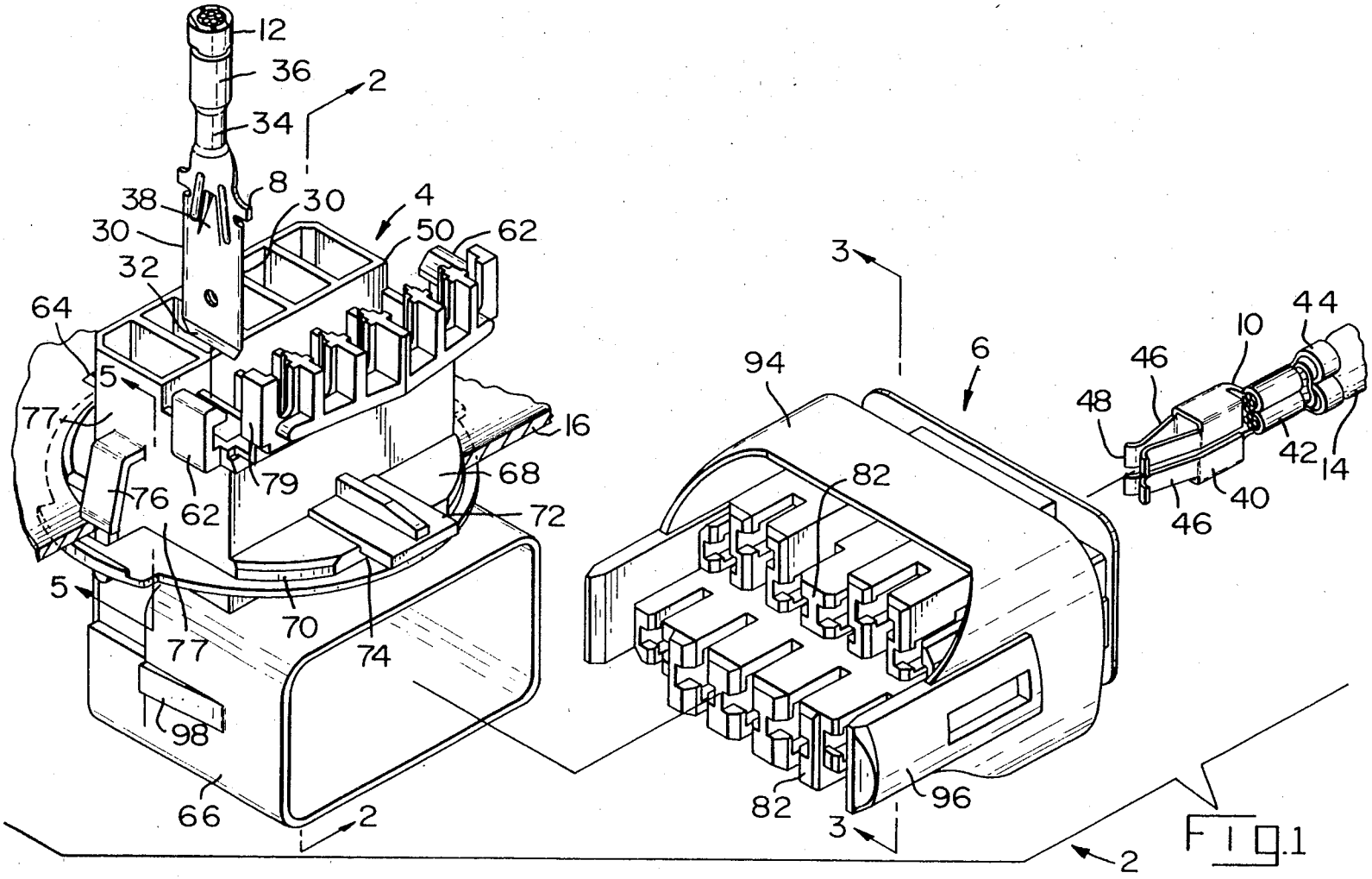
FIG. 1 is a perspective view of a connector assembly in accordance with the conjunction with the two housing parts separated from each other and with a single terminal exploded from each of the housings.

Referring first to FIG. 1, a connector assembly 2 in accordance with the invention comprises a first housing 4 containing first terminals 8, and a second housing 6 containing second terminals 10. Each of the first terminals 8 is connected to a first wire 12 and each of the second terminals 10 is connected to a second wire 14.

The connector assembly is intended specifically for use in a door panel 16, FIGS. 6–8 of an automobile or under other confined circumstances. As shown in FIGS. 6–8, the first housing 4 is mounted in an opening in panel 16 and projects into the space between the door panel 16 and an adjacent stationary panel 18 of the vehicle. The door is hinged to the frame by a hinge edge arm 20 pvioted to a bracket 22 on the frame. Reinforcing ribs or gussets 24 may be provided in the interior of the door and if necessary, openings are provided in these gussets to provide clearance for the connector.

The wires will normally extend through an opening in the frame panel 18 and to the second housing 6. The wires extending from the first housing 4 will extend to the electrical devices mounted in the door.

Each of the first terminals 8 has a flat blade type contact portion having oppositely facing major surfaces and side edges 30 which extend to the free end 32 of the blade. The terminal is crimped onto the metallic strands of the wire 12 by a wire crimp 34 and is crimped onto the insulation by an insulation crimp 36. The terminal has a lance 38 formed thereon by means of which its retained in the first housing.

Each of the second terminals 10 has a box-like rectangular intermediate portion 40 from which extend opposed spring arms 46. In the terminal shown, two pairs of arms are provided. The free ends of the arms of each pair are divergent as shown at 48 so that they will move smoothly over the side edges of the terminals 8 as will be described below. Each of the terminals 10 is crimped on to its wire 14 by a wire crimp 42 and an insulation crimp 44.

Figure 2:
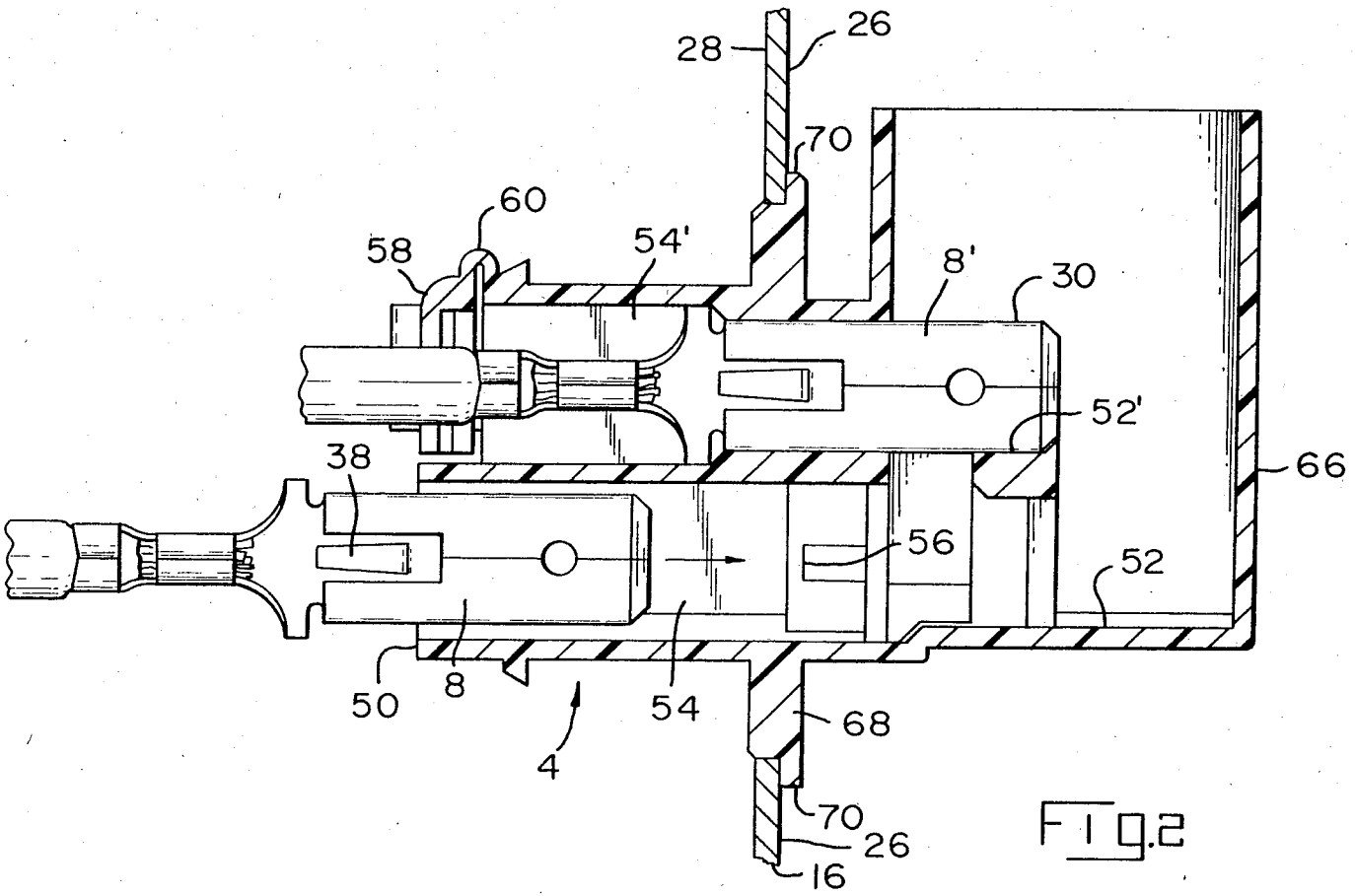
FIG. 2 is a view looking generally in the direction of the arrows 2—2 of FIG. 1 showing details of the first housing and showing one terminal partially inserted and another terminal fully inserted.
Figure 3:
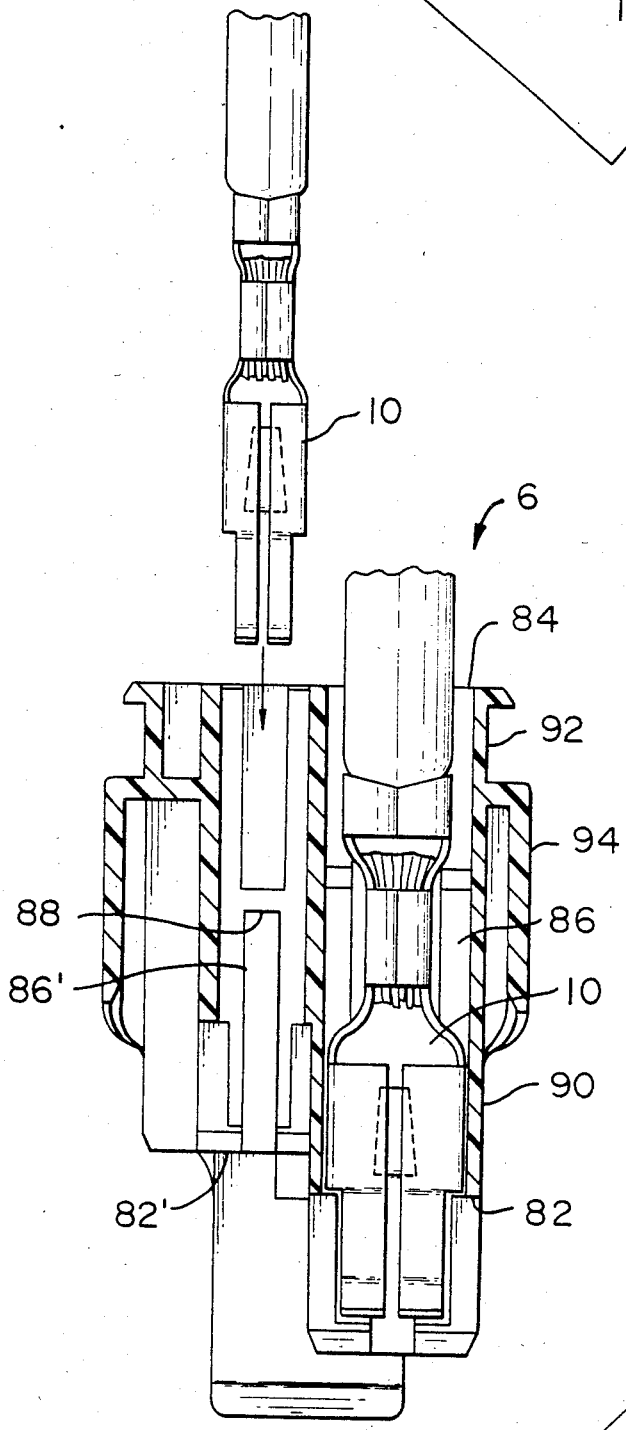
FIG. 3 is a view looking in the direction of the arrows 3—3 of FIG. 1.

The first housing 4 has a wire entry face 50, a mating face 52 and cavities 54, 54' extending from the wire entry face to the mating face. Each cavity receives a single terminal 8 as shown in FIG. 2 and has a shoulder 56 for cooperation with the lance 38 of the terminal. The terminals and cavities are arranged in two rows with the terminals and cavities of the upper row being indicating at 8' and 54'. The mating face has two levels as indicated at 52 and 52'. The terminals in the lower row project beyond the terminals in the upper row contained in the cavities 54' and the mating face is thereby stepped. The terminals in each row are in parallel spaced-apart planes with the terminals in the upper row being laterally offset from the terminals in the lower row.

Since the terminals in the cavities 54' in FIG. 2 extend into the cavities by a lesser amount by the terminals in the lower row as viewed in FIG. 2, the insulation crimp portions of the terminals in the upper row are located relatively close to the wire entry face 50 and it is desirable to provide an integral cover 58 for the terminals and wires of the upper row. This cover is formed integrally with the housing body and hinged thereto as shown at 60; FIG. 1 shows the cover in its opened position wire and FIG. 2 shows the cover closed onto the wires. The cover is latched in its closed position by latch arms 62, on the endwalls 77 of the housing, the cover having shoulder portions 79 which cooperate with these latch arms.

The cover 58 serves to partially surround the insulation crimp of each terminal in the upper row of terminals and additionally, acts as a guide when the wires are flexed.

A hood 66 extends vertically in FIG. 2 and projects beyond the edges 30 of the terminals in the upper row of cavities 54'. This hood is referred to as an inner hood for the reason that it is received within an outer hood on the second housing 6 as will be explained below.

In order to mount the first housing in an opening in the panel 16, a mounting collar 68 extends radially from the external surface of the first housing. Portions of the periphery of this mounting collar are provided with projecting lips 70 that extend beyond the exterior surface 26 of the panel 16 when the housing is moved into the opening from the right in FIG. 2. It is desirable also to provide a groove in the collar at one or more locations to receive edge portions of the panel. This groove is formed by providing an arm 72 on the collar which is opposed to the surface of the lip. In the disclosed embodiment a relatively short section of groove 74 is provided since it is not practical to provide a continuous groove in that it would be impossible to mount the housing in the panel opening.

Figure 5:
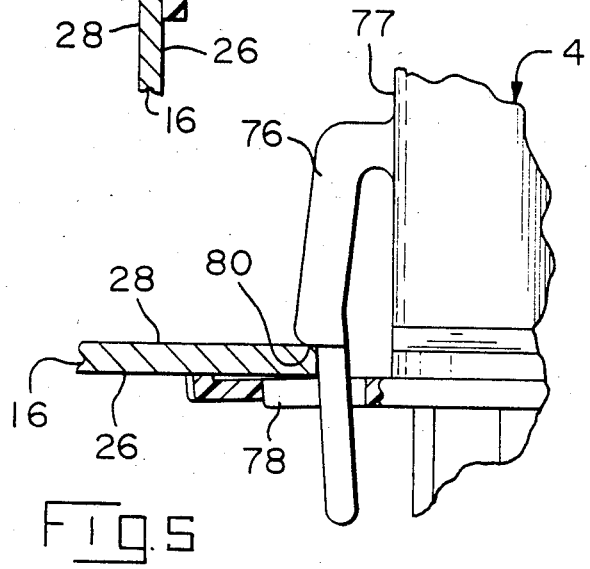
FIG. 5 is a fragmentary view showing details of a latch arm on the first housing, this view being taken along the lines 5—5 of FIG. 1.

To firmly secure the first housing in the panel opening, latch arms 76 are provided on endwalls 77 and extend through openings 78 of the collar, see FIG. 5. These latch arms have shoulders 80 which bear against the internal surface 28 of the panel 16 and prevent movement of the housing through the panel from the position of FIG. 5. The latch arms thus have fixed ends which are on one side of panel 16 and free ends which are on the other side.

The opening 78 is enlarged to the extent that the latch arms 76 can be moved towards the endwalls 77 so that the shoulders 80 of these latch arms will clear or move beyond the edge of the opening. It is possible to remove the first housing from the panel 16 from the side 26 of the panel if removal should be needed for servicing or repair.

Figure 4:
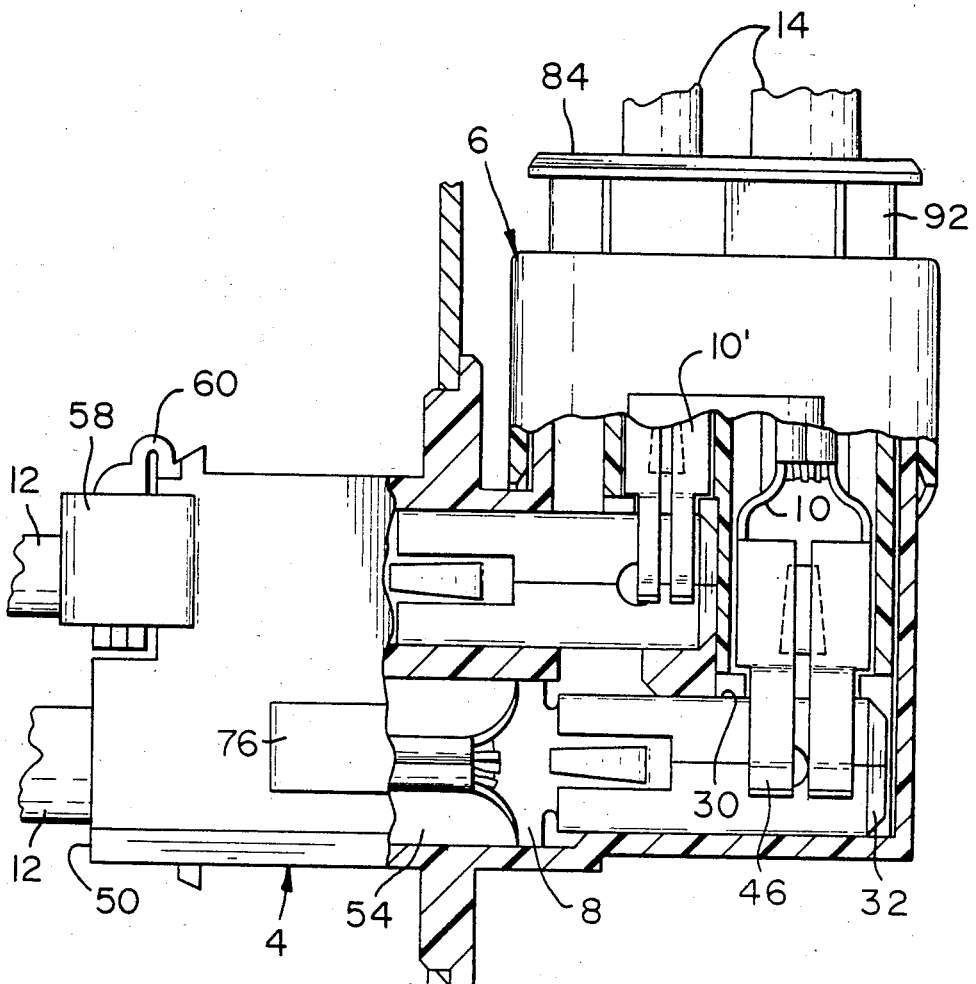
FIG. 4 is a cross-sectional view, partially in section and with parts broken away, showing the positions of the parts when the housings are mated with each other.

The second housing 6 has a mating face 82, a wire entry face 84 and cavities 86, 86' extending through the housing. The mating face is stepped as indicated by the reference numerals 82, 82' and terminals in the first row of cavities 86 project beyond the terminals in the row 86' of cavities. The terminals 10' mate with the blade terminals 8' in the first housing as shown in FIG. 4. In the embodiment of the invention herein disclosed, the terminals 10' are of smaller size than the terminals 10.

Lance shoulders 88 are provided for the retaining lances on the terminals 10 and a hood 94 extends from a location adjacent to the wire entry face 84 towards the mating face. This hood is spaced from the external surface 90 of the housing and is referred to as an outer hood. The inner hood 66 of the first housing is received between the hood 94 and the surface portions 90 of the housing.

A circumferential recess 92 is provided adjacent to the wire entry face 84. This recess receives a boot or sleeve of rubber or the like for providing a seal around the housing and around the wires.

The second housing is provided with latch arms 96 which extend from the hood 94 and which have openings that receive ears 98 on the hood 66 of the first housing to secure the housing in assembled relationship. In use, the wires extending from the terminals in the first housing will be inserted through the opening in the panel 16 and connected to the electrical devices contained in the door. The first housing 4 will then be inserted from the outside towards the opening in panel 16 and assembled to the panel in an orientation such that the mating faces 52, 52' are directed upwardly. It should be mentioned that FIG. 1 does not show a realistic orientation since the panel 16 is in a horizontal plane but this orientation was selected in order to reveal structural details of the housing.

The wires extending from the frame panel 18 will have a second housing 6 on their ends and the connections can be made by simply coupling this first housing to the second housing mounted in the door panel 16. It will be noted that since the assembly is in a vertical orientation as shown in FIG. 6, moisture will not enter the interior of the connector for the reason that the outer hood is in surrounding relationship to the inner hood.

The housing may be molded of any commonly used molding material, usually polyester with glass filler. The terminals are of a standard type as previously noted although they are not mated with each other in the usual manner; ordinarily, the leading end of a blade is inserted into the spring arms in an axial manner.

I claim:

1. A panel mount electrical connector assembly intended for use in confined spaces comprising first and second connector housings having first and second terminals therein respectively, each of the housings having a wire entry face and a mating face, the terminals extending from the mating faces of the housings, the mating faces being substantially against each other and the contact terminals being engaged with each other when the first and second housings are assembled to each other, wires extending into the wire entry faces of the housings and to the terminals, the wires being connected to the terminals, the connector assembly being characterized in that:

the connector assembly is substantially L-shaped, the first housing being one of the arms of the L and the second housing being on the other arm, the mating faces of the first and second housings being at the junction of the arms, the wire entry faces being at the ends of the arms, the first terminals in the first housing comprising rectangular blade terminals having side edges and having oppositely facing major surfaces between the side edges, the terminals in the second housing comprising blade receptacle terminals, the blade terminals being mounted in two parallel rows in the first housing and the receptacle terminals being mounted in two parallel rows in the second housing, each of the terminals having a free end which is spaced from the mating face of its respective housing, the free ends of the terminals in one of the rows in each of the housings being located beyond the free ends of the terminals in the other row, one of the housings being mountable in an opening in a panel so that the wire entry face of the one housing is on one side of the panel and the mating face is on the other side of the panel whereby, upon mounting the one housing in the opening in the panel and mating the other housing with the one housing, the mating faces of the housings will be adjacent to the other side of the panel and the other housing will extend substantially parallel to the other side of the panel.

2. A panel mount electrical connector assembly as set forth in claim 1 characterized in that the first housing is mountable in an opening in a panel and has panel mounting means on its external surface.

3. A panel mount electrical connector assembly as set forth in claim 2 characterized in that the panel mounting means comprises a collar extending radially from the first housing between the wire entry face and the mating face thereof, portions of the collar being dimensioned to extend beyond the opening in the panel, and at least one latch arm having a fixed end and a free end, the fixed end being on one side of the collar and the free end being on the other side of the collar, an intermediate portion of the latch arm extending through an opening in the collar, the latch arm having a shoulder thereon which faces towards the collar whereby portions of the panel will be held between the shoulder and the collar.

4. A panel mount electrical connector assembly as set forth in any one of claims 1, 2 or 3 characterized in that each of the second terminals comprises at least two side-by-side spring arms, the arms extending along the axis of the associated wire to which the terminal is connected, the arms having free ends and having side edges extending to the free ends whereby upon mating of the housings, the free ends of the spring arms of the terminals will move past one of the side edges of terminals in the first housing and the blade portions will be received by the spring arms.

5. A panel mount electrical connector assembly as set forth in claim 4 characterized in that one of the housings has an inner hood which surrounds and extends from the mating face of the one connector, the other connector having an outer hood thereon which surrounds the inner hood when the first and second housings are mated.

6. A panel mount electrical connector assembly as set forth in claim 5 characterized in that housing latching arms and shoulders are provided on the housings for latching the housings in mated condition.

7. A panel mount electrical connector assembly as set forth in claim 6 characterized in that the collar and the innner hood are on the first housing.

* * * * *